US007404826B2

(12) United States Patent
Taeger et al.

(10) Patent No.: US 7,404,826 B2
(45) **Date of Patent: *Jul. 29, 2008**

(54) METHOD FOR REMOVING HORN SUBSTANCE FROM SKINS, PELTS OR FURS

(75) Inventors: Tilman Luedecke Taeger, Seeheim-Jugenheim (DE); Gunther Pabst, Mannheim (DE); Philippe Lamalle, Lambsheim (DE); Stephan Hueffer, Ludwigshafen (DE); Stefan Schroeder, Neuleiningen (DE)

(73) Assignee: BASF SE, Ludwigshafen (DE)

( * ) Notice: Subject to any disclaimer, the term of this patent is extended or adjusted under 35 U.S.C. 154(b) by 446 days.

This patent is subject to a terminal disclaimer.

(21) Appl. No.: 10/513,800

(22) PCT Filed: May 19, 2003

(86) PCT No.: PCT/EP03/05231

§ 371 (c)(1),
(2), (4) Date: Nov. 18, 2004

(87) PCT Pub. No.: WO03/097880

PCT Pub. Date: Nov. 27, 2003

(65) Prior Publication Data

US 2005/0229326 A1 Oct. 20, 2005

(30) Foreign Application Priority Data

May 22, 2002 (DE) ..... 102 23 012

(51) Int. Cl.
*C14C 1/00* (2006.01)

(52) U.S. Cl. ..... 8/94.16; 8/94.1 R; 8/94.15; 8/94.18

(58) Field of Classification Search ..... 8/161, 8/94.15, 94.16, 94.1 R, 94.18
See application file for complete search history.

(56) References Cited

U.S. PATENT DOCUMENTS

| | | | | |
|---|---|---|---|---|
| 1,973,130 | A | 9/1934 | Turley et al. | |
| 3,097,912 | A * | 7/1963 | Booth | 8/94.16 |
| 3,865,546 | A * | 2/1975 | Zemlin et al. | 8/161 |
| 4,175,922 | A * | 11/1979 | Eckert et al. | 8/94.16 |
| 4,294,087 | A * | 10/1981 | Monsheimer et al. | 69/21 |
| 4,472,569 | A | 9/1984 | Gray et al. | |
| 4,484,924 | A | 11/1984 | Pfleiderer et al. | |
| 4,618,344 | A * | 10/1986 | Wells | 8/161 |
| 2005/0229326 | A1 | 10/2005 | Taeger et al. | |

FOREIGN PATENT DOCUMENTS

| | | | |
|---|---|---|---|
| AU | 30543/71 | * | 1/1973 |
| DE | 21 31 630 | | 1/1972 |
| DE | 199 33 968 | | 1/2001 |
| EP | 0 095 916 | | 12/1983 |
| EP | 0 096 521 | | 12/1983 |
| FR | 1 126 252 | | 11/1956 |
| WO | 2004/037589 | | 5/2004 |
| WO | 2004/038046 | | 5/2004 |
| WO | 2004/076738 | | 9/2004 |

OTHER PUBLICATIONS

Venizelos et al. "Studies on chrome tanning with high exhaustion of the tanning bath by masking and crosslinking in two separate steps," Bor-es Cipotechnika,36(3), pp. 93-94, 1986.*
Wickett et al. "Single-fiber stress decay studies of hair reduction and depilation." J. Soc. Cosmet. Chem., 37, 461-473, 1986.*
U.S. Appl. No. 10/579,714, filed May 17, 2006, Buehler, et al.
U.S. Appl. No. 10/529,744, filed Mar. 29, 2005, Taeger et al.
U.S. Appl. No. 10/513,800, filed Nov. 18, 2004, Taeger et al.
"Ill. Der Aescher—Enthaarung und Hautaufschluss", Bibliothek des Leders, vol. 2, pp. 62-167.
Heidemann, Eckhart. "Fundamentals of Leather Manufacture", Eduard Roether KG Druckerel und Verlag, pp. 165-218 1993.
Evans, R.M. et al. "Dithiols, Part III. Derivatives of Polyhydric Alcohols", J. Chem. Soc., pp. 248-258.

* cited by examiner

*Primary Examiner*—Lorna M. Douyon
*Assistant Examiner*—Tri V Nguyen
(74) *Attorney, Agent, or Firm*—Oblon, Spivak, McClelland, Maier & Neustadt, P.C.

(57) ABSTRACT

Horny substances are removed from hides, pelts or skins of dead animals by treating the hides, pelts or skins in aqueous liquor with one or more compounds of the formula I

I

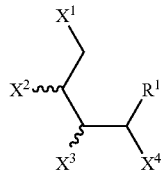

or their corresponding alkali metal or alkaline earth metal salts or ammonium or phosphonium salts, the variables being defined as follows:

$R^1$ is selected from hydrogen and $C_1$-$C_{12}$-alkyl, unsubstituted or substituted by one or more S—H or O—H groups;

$X^1$ to $X^4$ are identical or different and are selected from hydrogen, $C_1$-$C_4$-alkyl, O—H, S—H and N—$HR^2$, $R^2$ is hydrogen or $C_1$-$C_{12}$-alkyl or a $C_1$-$C_4$-Alkyl-C═O group, at least one radical $X^1$ to $X^4$ being S—H when $R^1$ contains at least one sulfur atom and at least two radicals $X^1$ to $X^4$ being S—H when $R^1$ contains no sulfur atom.

9 Claims, No Drawings

METHOD FOR REMOVING HORN SUBSTANCE FROM SKINS, PELTS OR FURS

CROSS REFERENCES TO RELATED APPLICATIONS

This application is a national stage application of International Patent Application No. PCT/EP03/05231, filed on May 19, 2003, and claims priority to German Patent Application No. 102 23 012.9, filed on May 22, 2002, both of which are incorporated herein by reference in their entireties.

The present invention relates to a process for removing horny substances from hides, pelts or skins of dead animals, wherein the hides, pelts or skins are treated in aqueous liquor containing one or more compounds of the formula I

I

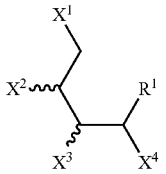

or their corresponding alkali metal or alkaline earth metal salts or ammonium or phosphonium salts, the variables being defined as follows:

$R^1$ is selected from hydrogen and $C_1$-$C_{12}$-alkyl, unsubstituted or substituted by one or more S—H or O—H groups;

$X^1$ to $X^4$ are identical or different and are selected from hydrogen, $C_1$-$C_4$-alkyl, O—H, S—H and N—$HR^2$, $R^2$ is hydrogen or $C_1$-$C_{12}$-alkyl or a $C_1$-$C_4$-alkyl-C═O group, at least one radical $X^1$ to $X^4$ being S—H when $R^1$ contains at least one sulfur atom and at least two radicals $X^1$ to $X^4$ being S—H when $R^1$ contains no sulfur atom.

Animal hides have been processed to leather for several thousand years. Before it is possible to begin the actual leather production, the tanning, the hides must be prepared. These preparation steps generally take place in the beam house and comprise numerous operations. Most of these operations serve for separating off those components of the hides which are undesired in the subsequent leather production or in the subsequent leather. As a rule, the undesired components include the hairs together with the hair roots and the epidermis. The unhairing of the hides is usually promoted by chemicals. A distinction is made between oxidative, reductive and enzymatic unhairing methods. An overview of methods can be found in Herfeld, Bibliothek des Leders, Vol. 2, 1988, pages 62-167, and in E. Heidemann, Fundamentals of Leather Manufacturing, E. Roether K G Druckerei und Verlag, Darmstadt 1993, pages 165-218.

In general, the unhairing of the hides is carried out substantially or completely during liming or painting. Conventional unhairing reagents which are advantageous in production are $Na_2S$ and NaSH, the latter often also being referred to as sodium sulfhydrate. Both salts can usually be used in highly contaminated form; the technical-grade $Na_2S$ often has an $Na_2S$ content which does not exceed 65% by weight, and technical-grade NaHS usually contains 70-72% by weight of NaHS. However, both, $Na_2S$ and NaHS, have disadvantages when used in practice. For safety reasons, $Na_2S$ and NaHS can be used only in a strongly alkaline medium because they evolve toxic and foul-smelling hydrogen sulfide on acidification. The elimination of the unconsumed sulfide, in particular sulfide-containing wastewaters, is an unsafe step for ecological and process engineering reasons. If excess sulfide is precipitated, for example with $Fe^{2+}$ or $Fe^{3+}$, iron sulfide sludges which are complicated to separate off are obtained. It is also possible to attempt to convert sulfides into ecologically safe salts by oxidation with, for example, $H_2O_2$, where corrosion problems have to be accepted.

There has therefore been no lack of attempts to use reagents other than $Na_2S$ or NaHS for treating the hides of dead animals. Most attempts start from SH-containing organic reagents.

U.S. Pat. No. 1,973,130 describes the use of numerous organic sulfur compounds, in particular in the presence of lime (column 1, line 40), for unhairing, for example, calves, hides. However, ethyl mercaptan in particular is a foul-smelling reagent, and ethyl mercaptan-containing wastewaters are difficult to work up, which prevents their use in a beam house.

FR 1.126.252 describes the unhairing of animal hides by the action of water-soluble thiols, in particular of thioglycolamide (example 1) or thioglycerol (example 2), in the presence of ammonium sulfate at a pH of 7-8 on animal hides.

However, attempts to substitute $Na_2S$ or NaHS by mercaptoacetic acid or mercaptoethanol or their alkali metal or alkaline earth metal salts are unsuccessful because both reagents and also their alkali metal or alkaline earth metal salts readily eliminate hydrogen sulfide and have an extremely unpleasant smell. Furthermore, wastewaters from the beam house containing ercaptoacetic acid or mercaptoethanol or decomposition products and byproducts, are difficult to clarify and emit unpleasant odors.

The use of 1,4-dimercaptobutanediol-containing formulations for removing horny substances, in particular hairs, from living tissue, for example in the case of undesired beard growth, is known from the cosmetic industry. Thus, DE 21 31 630 shows that compositions consisting of at least 0.25% by weight of dimercaptobutanediol and from about 0.01 to 40% by weight of a water-soluble guanidine compound and having a pH of less than 12 can be applied to guinea pigs in order to unhair them or to human horny skin in order to eliminate calluses without the occurrence of skin irritations in guinea pigs or even erythremia (malignant tumors of the formative system of the red blood corpuscles). The epidermis is preserved in the treatment described in DE 21 31 630.

EP-A 095 916 discloses the use of formulations containing aminoethanethiol and 1,4-dimercaptobutanediol and an aminoguanidine or diguanide compound, for eliminating undesired human body and facial hair. On page 2, line 1, it is stated that small thiol molecules are preferably used for bringing about rapid unhairing because they penetrate more rapidly into the skin. The epidermis is preserved in the treatment described in EP-A 0 095 916.

EP-A 096 521 discloses the use of formulations containing, for example, 1,4-dimercaptobutanediol and an aminoguanidine or diguanide compound for eliminating undesired human body and facial hair. The epidermis is preserved in the treatment described in EP-A 0 096 521.

Finally, it is known that collagen can be modified by breaking S—S bridges in the collagen by reaction with dithioerythrol and subsequent chlorination with chloroacetamide or chloroacetic acid, cf. for example E. Heidemann, Fundamentals of Leather Manufacturing, E. Roether K G Druckerei und Verlag, Darmstadt 1993, page 253. Furthermore, protein solutions can be preserved by adding dithioerythrol or dithiothreitol. The preservation is based on a type of protection from oxidation, because dithioerythrol is usually oxidized first instead of the protein SH groups.

It has now surprisingly been found that the process defined at the outset is very useful for removing horny substances from hides, pelts and skins of dead animals.

In the context of the present invention, horny substances are understood as meaning calluses, feathers, nail and claw parts and in particular hairs of animals.

The hides and epidermis may still contain residues of flesh of the relevant dead animals. What is essential to the invention, however, is that they contain horny substances. The amount of horny substance, based on the total weight of the hide or of the pelt or of the skin, is not critical. The novel process is suitable both for removing large amounts of horny substance and for removing small hair residues.

In the context of the present invention, dead animals are understood as meaning not only slaughtered animals, animals killed by hunters or animals deliberately killed in another manner by humans but also animals which have died as a result of accidents, for example traffic accidents, or fights with their own species or other animals or through natural causes, such as age or disease.

Hides, pelts or skins of animals are usually hides, pelts or skins of cattle, calves, pigs, goats, sheep, lambs, elks, game, for example stags or does, and furthermore birds, for example ostriches, fish or reptiles, such as snakes.

The process according to the invention is advantageously carried out as follows.

The hides are treated with one or more compounds of the formula I

I

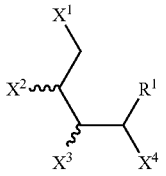

or the corresponding alkali metal or alkaline earth metal salts or ammonium or phosphonium salts, also referred to below as corresponding salts, in formula I the radicals being defined as follows:

$R^1$ is selected from $C_1$-$C_{12}$-alkyl, such as methyl, ethyl, n-propyl, isopropyl, n-butyl, isobutyl, sec-butyl, tert-butyl, n-pentyl, isopentyl, sec-pentyl, neopentyl, 1,2-dimethylpropyl, isoamyl, n-hexyl, isohexyl, sec-hexyl or n-decyl, particularly preferably $C_1$-$C_4$-alkyl, such as methyl, ethyl, n-propyl, isopropyl, n-butyl, isobutyl, sec-butyl and tert-butyl;

$C_1$-$C_{12}$-alkyl, substituted by one or more hydroxyl or thiol groups, such as hydroxymethyl, 2-hydroxyethyl, 1,2-dihydroxyethyl, 3-hydroxy-n-propyl, 2-hydroxyisopropyl, ω-hydroxy-n-butyl, ω-hydroxy-n-decyl, HS—$CH_2$—; HS—$(CH_2)_2$— or HS—$(CH_2)_3$—, and very particularly preferably hydrogen, $X^1$ to $X^4$ are identical or different and are selected from hydrogen, $C_1$-$C_4$-alkyl, such as methyl, ethyl, n-propyl, isopropyl, n-butyl, isobutyl, sec-butyl or tert-butyl O—H, S—H or N—$HR^1$, in particular O—H or S—H, $R^2$ is hydrogen or $C_1$-$C_{12}$-alkyl, such as methyl, ethyl, n-propyl, isopropyl, n-butyl, isobutyl, sec-butyl, tert-butyl, n-pentyl, isopentyl, sec-pentyl, neopentyl, 1,2-dimethylpropyl, isoamyl, n-hexyl, isohexyl, sec-hexyl or n-decyl, particularly preferably $C_1$-$C_4$-alkyl, such as methyl, ethyl, n-propyl, isopropyl, n-butyl, isobutyl, sec-butyl or tert-butyl;

or H—C═O or a $C_1$-$C_4$-alkyl-C═O group, for example acetyl, $C_2H_5$—C═O, n-$C_3H_7$—C═O, iso-$C_3H_7$—C═O, n-$C_4H_9$—C═O, iso-$C_4H_9$—C═O, sec-$C_4H_9$—C═O, tert-$C_4H_9$—C═O.

At least one radical $X^1$ to $X^4$ is an S—H group when $R^1$ contains at least one sulfur atom, and at least two radicals $X^1$ to $X^4$ are an S—H group when $R^1$ contains no sulfur atom.

Preferably at least one group $X^1$ to $X^4$ is hydroxyl and particularly preferably at least two radicals $X^1$ to $X^4$ are hydroxyl.

Among the corresponding alkali metal and alkaline earth metal salts, the mono- and disodium salts, mono- and dipotassium salts and potassium sodium salts of the compounds of the formula I may be mentioned, and furthermore the calcium and magnesium salts. The ammonium salts and primary, secondary, tertiary and in particular quaternary mono- and diammonium salts and phosphonium salts may also be mentioned. Mixtures of compounds of the formula I and their corresponding alkali metal or alkaline earth metal salts or ammonium or phosphonium salts can of course also be used.

Preferred mono- and diammonium salts have, as cations, those of the formula $N(R^3)(R^4)(R^5)(R^6)^+$, where $R^3$ to $R^6$ are in each case identical or different and are selected from hydrogen, $C_1$-$C_{12}$-alkyl, phenyl or $CH_2$—$CH_2$—OH. Examples are tetramethylammonium, tetraethylammonium, methydiethanolammonium and n-butyldiethanolammonium. Preferred mono- and diphosphonium salts have, as cations, those of the formula $P(R^3)(R^4)(R^5)(R^6)^+$, where $R^3$ to $R^6$ are as defined above.

One or more 1,4-dimercaptobutanediols selected from I a, I a' and I b,

Ia

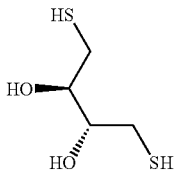

Ia'

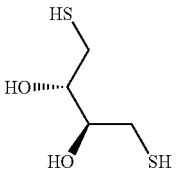

Ib

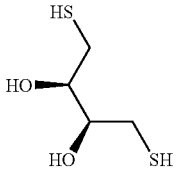

or their corresponding alkali metal or alkaline earth metal salts are very particularly preferably used. I a and I a' are also referred to as dithiothreitol and I b is also referred to as dithioerythrol. The use of racemic dithiothreitol is very particularly preferred. I a, I a' and I b are practically odorless, easily meterable and readily water-soluble compounds.

The compounds I a or I a' and I b are known and are commercially available, for example, from Aldrich or AGROS Chemicals. The synthesis of further compounds of the formula I can be carried out as described in U.S. Pat. No. 4,472,569 or J. Chem. Soc. 1949, 248 or by analogous reactions.

In general, an amount of from 0.1 to 5% by weight, based on the hide or salt weight of the hides, pelts or skins, is sufficient. From 0.1 to 2.5% by weight are preferred and from 0.1 to 1.5% by weight are particularly preferred.

The treatment according to the invention of the hides, pelts or skins with one or more compounds of the formula I is preferably carried out during liming or painting, both under hair-destroying and under hair-preserving conditions. During liming or painting, it is possible to manage with a concentration of less than 1% by weight of $Na_2S$ or NaHS instead of the usual concentration of about 4% by weight of $Na_2S$ or NaHS or even slightly more, while obtaining an equally great effect with regard to removal of horny substances.

In one variant of the process according to the invention, one or more compounds of the formula I are used together with thiols known from tanning, for example mercaptoethanol or thioglycolic acid, during liming. Preferably, less than 0.5% by weight of mercaptoethanol or thioglycolic acid is used.

In a very particularly preferred variant of the process according to the invention, however, it is possible to dispense with the use of $Na_2S$ or NaHS or other foul-smelling sulfur-containing reagents.

According to the invention, the hides are treated in an aqueous liquor. The liquor ratio is from 1:10 to 10:1, preferably from 1:2 to 4:1, particularly preferably up to 3:1, based on the hide weight or salt weight of the hides.

The process according to the invention is carried out at a pH of from 7 to 14, preferably from 8 to 13, particularly preferably from 9 to 12.5.

The pH can be adjusted by adding up to 3% by weight, based on the liquor, of lime (also calcium hydroxide). However, the amount of lime can also be substantially reduced. In a preferred variant of the process according to the invention, the use of lime is dispensed with. In the preferred embodiment, one or more inorganic basic alkali metal compounds are added, for example one or more hydroxides or carbonates of alkali metals, preferably of sodium or potassium, very particularly preferably of sodium. Other suitable inorganic basic alkali metal compounds are alkali metal silicates. Basic amines, for example ammonia, methylamine, dimethylamine, ethylamine or triethylamine, or combinations of alkali metal compound and one or more basic amines, may also be added.

In addition to water, further organic solvents may also be in the liquor, for example up to 20% by volume of ethanol or isopropanol.

The process can be carried out in the vessels which are customary in the tannery and in which liming is usually effected. The process according to the invention is preferably carried out in rotatable drums comprising internals. The speed is usually from 0.5 to 100/min, preferably from 1.5 to 10/min, particularly preferably up to 4.5/min.

The pressure and temperature conditions for carrying out the process according to the invention are in general not critical. It has proven suitable to carry out such process at atmosphere pressure; a pressure increased up to 10 bar is also conceivable. Suitable temperatures are from 10 to 45° C., preferably from 15 to 35° C., particularly preferably from 25 to 30° C.

The compound or compounds of the formula I can be metered at the beginning of the liming process but it is also possible first to soak the hides under basic conditions and to meter one or more compounds of the formula I after some time. The metering can be effected in one step, i.e. the total amount of the compound or compounds I used is metered in one step; however, I can also be metered in portions or continuously.

The process according to the invention can be carried out in a period of from 10 minutes to 48 hours, preferably from 1 to 36 hours, particularly preferably from 3 to 15 hours.

Auxiliaries customary in the tannery, for example phosphines, e.g. triphenylphosphine or tris(2-carboxyethyl)phosphine hydrochloride, and furthermore hydroxylamine, urea, guanidine or guanidinium hydrochloride, hydrazine, biocides, enzymes, surfactants and emulsifiers can of course also be added for carrying out the process according to the invention.

Excellently unhaired pelts can be produced by means of the process according to the invention. Surprisingly, it is also found that the epidermis is completely or at least substantially detached after only a short treatment time. The present invention therefore relates to pelts produced by the process according to the invention.

Furthermore, it was surprisingly found that the pelts produced according to the invention are very suitable for the production of leather. After further processing of the pelts according to the invention by methods customary in the tannery, i.e. bating, if required deliming, pickling, chrome-free tanning or chrome tanning, retanning and finishing, it is observed that the pelts produced according to the invention can be further processed to give leather having an improved surface yield and less swelling damage compared with leather which is produced from pelts which were unhaired with the aid of, for example, $Na_2S$, NaHS, thioglycolic acid or aminoethanol.

The present invention furthermore relates to leather produced from the pelts according to the invention. Overall, they have advantageous performance characteristics.

It has furthermore been found that the wastewater formed in the process according to the invention, in particular wastewaters from liming processes without the use of $Na_2S$, NaSH or mercaptans, such as aminoethanol or thioglycolic acid, can be particularly readily worked up. After the end of the action of one or more compounds of the formula I on the hides, pelts or skins of dead animals, the pelts obtained are separated from the liquor, for example by simply removing the pelts or by discharging the liquor. The liquor contains, inter alia, unconsumed (unreacted) compound of the formula I, in an amount of from a few ppm to 4% by weight, in addition to basic alkali metal compound or basic amines or lime and in particular residues of the horny materials and of the epidermis separated from the pelts. The liquor which has been separated off and which contains unconsumed (unreacted) compound of the formula I and furthermore base and residues of the horny materials and of the epidermis separated from the pelts is also referred to below as residual liquor. The present invention therefore furthermore relates to residual liquors which contain neither $Na_2S$ nor NaHS and contain, as organic sulfur compounds, only those of the formula I and their reaction products and byproducts from the removal of horny substances from hides, pelts or skins of dead animals, and organic sulfur compounds which originate from the hides, pelts or skins of the dead animals. In the context of the present invention, residual liquors which contain neither $Na_2S$ nor NaSH are to be understood as meaning those residual liquors which contain up to 100 ppm, preferably up to 75 ppm, of sulfide. The sulfide determination is effected in the form of hydrogen sulfide after acidification with concentrated hydrochloric acid, heating to 90° C. and stripping. The residual liquors according to the invention are obtainable by the process according to the invention. They are virtually odorless and particularly simple to work up in comparison with the tannery residual liquors known from the prior art.

Examples of reaction products and byproducts of compounds of the formula I which result from the removal of horny substances from the hides, pelts or skins of dead animals are mainly hydrolysis and oxidation products of compounds of the formula I.

It has now been found that the residual liquors according to the invention can be particularly easily worked up.

The present invention therefore furthermore relates to a process for working up residual liquors. The process according to the invention comprises a plurality of steps.

In a first, optional step, the pelts according to the invention are separated from the lime. This step is of course required only when lime has been used in the treatment of the animal hides, otherwise it is not required. Separation is effected by settling out, flotation, decanting, filtration or centrifuging, it being preferable to separate off the lime by decanting, settling out or filtration in the case of large amounts of residual liquors according to the invention. Lime-free residual liquors are obtainable by the first step described above.

The lime-free residual liquors are then neutralized with an acid until a pH of from 2 to 8, preferably from 3 to 7, particularly preferably from 4 to 5, has been reached.

Suitable acids are toxicologically safe organic or inorganic acids. Examples are hydrochloric acid, phosphoric acid, formic acid, sulfuric acid, acetic acid, citric acid, carbonic acid ($CO_2$), adipic acid and dicarboxylic acid mixtures comprising adipic acid, glutaric acid and succinic acid. No particular measures with regard to evolving hydrogen sulfide are required during acidification.

The proteins removed from the pelt during liming or painting are precipitated or float so that they are separated off mechanically in a further step, for example by filtration or flotation.

The working examples which follow illustrate the invention.

WORKING EXAMPLES

General Methods

1. Liming (Hair-destroying)

The values in % by weight are based in each case on the salt weight, unless stated otherwise.

A Southern German cattle hide was first presoaked at 28° C. with 200% by weight of water and 0.2% by weight of an Eusapon® W for 120 minutes in a drum at 1-3 rpm. The liquor was discharged and then soaking was effected with 100% by weight of water, 0.2% by weight of Eusapon® W and 0.5% by weight of sodium carbonate for 19 hours during automatic operation (5'/h). The liquor was then discharged.

The soaked South German cattle hides were fleshed in the green state (thickness about 4 mm) and the butts of the hides were cut into pieces of hide each having a green weight of 2.5 kg.

Below, the values in % by weight are based in each case on green weight, unless stated otherwise.

1.1. Liming of Comparative Example C1

For comparative example C1, 100 parts by weight, based on green weight, were treated in succession with 60 parts by weight of water, 0.8% by weight of NaSH and 3% by weight of calcium hydroxide in a rotatable 10 l drum containing baffles. 0.75% by weight of sodium sulfide followed at 30 minute intervals. The drum was operated for a further 45 minutes at 15 rpm. A further 40 parts by weight of water were then metered. After 10 hours at from 23 to 27° C. and 5 rpm, the experiments were terminated by discharging the liquor and the hides were washed twice for 15 minutes with 150 parts by weight of water.

1.2. Hair-destroying Liming of Examples 1 to 6 According to the Invention

In examples 1 to 6 according to the invention, first 60% by weight of water were added to 100 parts by weight, based on green weight, in a rotatable 10 l drum containing baffles and then treatment with products was carried out, as shown in table 1.

TABLE 1

| Ex. | Amount used [% by wt.] | Product | Time [min] |
|---|---|---|---|
| 1.1 | 0.5 | Sodium sulfhydrate (70%) | |
| | 0.5 | Rac. dithiothreitol | 60 |
| | 1.2 | Calcium hydroxide | 60 |
| | 1.2 | Calcium hydroxide | 60 |
| 1.2 | 1.0 | Rac. dithiothreitol | 60 |
| | 1.2 | Calcium hydroxide | 60 |
| | 1.2 | Calcium hydroxide | |
| 1.3 | 1.5 | Rac. dithiothreitol | 60 |
| | 1.2 | Calcium hydroxide | 60 |
| | 1.2 | Calcium hydroxide | 60 |
| 1.4 | 0.5 | Mollescal MF | |
| | 1.0 | Rac. dithiothreitol | 60 |
| | 1.0 | Aqueous sodium hydroxide solution (50% by weight) | 30 |
| | 1.0 | Aqueous sodium hydroxide solution (50% by weight) | 30 |
| | 50 | Water | |
| | 0.4 | Aqueous sodium hydroxide solution (50% by weight) | 60 |
| | 50 | Water | 30 |
| 1.5 | 1.0 | Basyzym L10 | |
| | 0.5 | Rac. dithiothreitol | 60 |
| | 1.0 | Aqueous sodium hydroxide solution (50% by weight) | 30 |
| | 1.0 | Aqueous sodium hydroxide solution (50% by weight) | 30 |
| | 0.4 | Aqueous sodium hydroxide solution (50% by weight) | 60 |
| | 50 | Water | 30 |
| 1.6 | 1.0 | Rac. dithiothreitol | 60 |
| | 1.0 | Aqueous sodium hydroxide solution (50% by weight) | 30 |
| | 1.0 | Aqueous sodium hydroxide solution (50% by weight) | 30 |
| | 50 | Water | |
| | 0.4 | Aqueous sodium hydroxide solution (50% by weight) | 60 |
| | 50 | Water | 30 |

The drum was operated for a further 45 minutes at 5 rpm. A further 40% by weight of water was then metered. After 10 hours at from 23 to 27° C. with periodic operation at 3 rpm for in each case 5 minutes per hour, the experiments were terminated by discharging the liquor and the pelts were washed twice for 15 minutes each time with 150% by weight of water.

1.3. Assessment of the Comparative Example and of the Examples According to the Invention and of the Residual Liquors After Liming The pelts treated according to the examples according to the invention were only slightly superior to the hides treated according to comparative example C1 with respect to swelling but had a smoother and flatter grain, especially the pelts of examples 1.4 to 1.6 according to the invention. The epidermis and the hairs with hair root in the pelts 1.1 to 1.3 had been substantially destroyed and those in the pelts 1.4 to 1.6 had been completely destroyed.

1.4. Further Treatment of the Residual Liquors

The residual liquors of examples 1.1 to 1.6 according to the invention were acidified to pH 4.5 with formic acid without evolution of hydrogen sulfide being observed. The precipitated proteins were then separated off by filtration without problems. The residual liquors of examples 1.4 to 1.6 were virtually clear.

2. General Method for the Further Processing of the Pelts from C1 and the Pelts 1.1 to 1.6 According to the Invention The deliming or neutralization was carried out in each case using a mixture consisting of two parts by weight of formic acid and three parts by weight of adipic acid. For this purpose, the liquor was brought to pH 7.5-8.5 in two metering steps. The penetration of the acid mixture over the hide cross-section was checked using phenolphthalein as indicator. The time required for this purpose was noted.

The intermediates obtained above were then pickled at 25° C. over a period of 30 minutes with 7% by weight of sodium chloride in a conventional pickle bath. Thereafter, 1% by weight of Lipoderm Licker® A1 was added, followed after a further 20 minutes by 4% by weight of formic acid. After a further half an hour, a pH of 3 was established with concentrated sulfuric acid.

In each case 2.5% by weight of a glutaraldehyde formulation, commercially available as Relugan® GT 24 from BASF Aktiengesellschaft, were added to the pickle baths described above. After 90 minutes, 3% by weight of a synthetic tanning agent, commercially available as Basyntan® SW fl. from BASF Aktiengesellschaft, were added. After 30 minutes, 1% by weight of a tanning agent based on naphthalenesulfonic acid, commercially available as Tamol® M from BASF Aktiengesellschaft, was added and the bath was left to stand overnight. Neutralization was then effected with sodium formate and sodium bicarbonate and the liquor was discharged.

The leathers thus obtained were washed with water, dried by a conventional method, set out and shaved. The shaved thickness of the leathers was 2.0-2.2 mm. Below, the data in % by weight are based in each case on the dried leather, unless stated otherwise.

The wet white cattle leathers thus obtained were placed in 100% by weight of water and brought to a pH of <3.0 by adding sodium formate and sodium bicarbonate. The leather was drummed at 30° C. for 60 minutes and then washed with 200% by weight of water.

Thereafter, 4% by weight of Relugan® GTP were added and drumming was carried out for 60 minutes. After addition of 2% by weight of Tamol® NA, commercially available from BASF Aktiengesellschaft, and drumming for 30 minutes, 3% by weight of the fatliquoring agent Lipoderm® Licker A1, commercially available from BASF Aktiengesellschaft, and 1% by weight of Lipoderm® Licker LA, commercially available from BASF Aktiengesellschaft, were added and drumming was carried out for 60 minutes. After the liquor had been discharged, 100% by weight of water at 40° C. and 2% by weight of commercial polymer tanning agent (Relugan® SE), commercially available from BASF Aktiengesellschaft, were added.

After partial neutralization of the liquor with sodium bicarbonate to pH 5 and dyeing of the leather in the same liquor with 0.5% by weight of the leather dye Luganil® Light Brown NGB, commercially available from BASF Aktiengesellschaft, tanning was completed with 30% by weight of commercial sulfone tanning agent (Basyntan® SW liquid) and 4% by weight of commercial tare (Granofin® TA, from Clariant Deutschland GmbH) for 2 hours.

Fatliquoring was then carried out with a mixture of 8% by weight of fatliquoring agent (Lipoderm® Licker A1) and 4% by weight of Lipoderm® Licker LA 1. Thereafter, the liquor was brought to a pH of from 3.5 to 3.8 with formic acid, and the leather was briefly subjected to a cold wash and further processed in a generally customary manner.

The physical properties and performance characteristics were then tested.

Crust leathers 2.1. to 2.6. having a very good dyeing and tight grain in combination with very good body and excellent softness with elegant handle were obtained. The crust leathers 2.4 to 2.6 had a smoother and finer grain than C2. Further performance characteristics are shown in table 2.

TABLE 2

| Crust leather | From pelt | Hair decomposition | Tight-grained character Wet white leather | Stitch tear resistance according to DIN 53331 [N] |
|---|---|---|---|---|
| C2 | C1 | 2 | 2 | 140 |
| 2.1 | 1.1 | 2 | 2 | 176 |
| 2.2 | 1.2 | 1.5 | 2 | 173 |
| 2.3 | 1.3 | 1 | 2 | 178 |
| 2.4 | 1.4 | 1 | 1 | 185 |
| 2.5 | 1.5 | 1 | 1 | 190 |
| 2.6 | 1.6 | 1.5 | 1 | 188 |

The hair decomposition and the tight-grained character were assessed optically and haptically by two testers (1: very good, 6: inadequate).

3. Liming (Hair-preserving)

A South German cattle hide was first presoaked at 28° C. with 150% by weight of water and 0.2% by weight of Eusapon® W for 120 minutes in a drum at 1-3 rpm. The liquor was discharged and then soaking was carried out with 150% by weight of water, 0.2% by weight of Eusapon® W and 0.5% by weight of sodium carbonate for 19 hours with occasional stirring. The liquor was then discharged.

The soaked South German cattle hides were fleshed in the green state (thickness about 4 mm) and the butts of the hides were cut into pieces of hide of 2.5 kg each.

Below, the values in % by weight are based in each case on the green weight, unless stated otherwise.

3.1. Hair-preserving Liming of Comparative Example C3

For comparative example C3, 100 parts by weight, based on green weight, were treated in succession with 60% by weight of water and, in each case after 60 minutes, 1.2% by weight of Mollescal MF®, commercially available from BASF Aktiengesellschaft, 0.8% by weight of calcium hydroxide and 1% by weight of sodium sulfide (60%) in a rotatable 10 l drum containing baffles. Filtration was then carried out over a period of 120 minutes. A further 1.6% by weight of calcium hydroxide and 40% by weight of water followed after 60 minutes. After 10 hours at from 23 to 27° C.

with periodic operation at 3 rpm for in each case 5 minutes per hour, the experiments were terminated by discharging the liquor and the pelts were washed twice for 15 minutes each time with 150% by weight of water.

3.2 Hair-preserving Liming of Examples 3.1. to 3.3 According to the Invention First, 60% by weight of water were added to 100 parts by weight, based on green weight, in a rotatable 10 l drum containing baffles and then treatment with products was carried out as shown in table 3.

TABLE 3

| Example | Amount used [% by wt.] | Product | Time [min] |
|---|---|---|---|
| 3.1 | 0.5 | Rac dithiothreitol | 60 |
| | 0.8 | Calcium hydroxide | 60 |
| | | Followed by beginning of filtration for 120 minutes | |
| | 0.5 | Dithiothreitol | |
| | 1.6 | Calcium hydroxide | 60 |
| | 40 | Water | 60 |
| 3.2 | 0.5 | Rac dithiothreitol | 60 |
| | 0.8 | Aqueous sodium hydroxide solution (50% by weight) | 30 |
| | | Followed by beginning of filtration for 120 minutes | |
| | 1.2 | Aqueous sodium hydroxide solution (50% by weight) | 30 |
| | 50 | Water | |
| | 0.4 | Aqueous sodium hydroxide solution (50% by weight) | 60 |
| | 50 | Water | 30 |
| 3.3 | 1.0 | Rac dithiothreitol | 60 |
| | 0.8 | Aqueous sodium hydroxide solution (50% by weight) | 30 |
| | | Followed by beginning of filtration for 120 minutes | |
| | 1.2 | Aqueous sodium hydroxide solution (50% by weight) | 30 |
| | 50 | Water | |
| | 0.4 | Aqueous sodium hydroxide solution (50% by weight) | 60 |
| | 50 | Water | 30 |

The drum was operated for a further 45 minutes at 15 rpm. A further 40 parts by weight of water were then metered. After 10 hours at from 23 to 27° C. with periodic operation at 3 rpm for in each case 5 minutes per hour, the experiments were terminated by discharging the liquor and the pelts were washed twice for 15 minutes each time with 150% by weight of water.

3.3. Assessment of Comparative Example C3 and of the Examples According to the Invention The pelts treated according to the examples according to the invention were only slightly superior to the hides treated according to comparative example C3 with respect to the swelling but had a smoother and flatter grain, especially the pelts of examples 3.2 and 3.3 according to the invention. The epidermis and the hairs with hair root in pelt 3.1 had been substantially destroyed and those in pelts 3.2 to 3.3 had been completely destroyed.

The pelts from C3 and 3.1 to 3.3 were then further processed as described under 2.

The physical properties and performance characteristics were then tested.

Crust leathers 4.1. to 4.2. having a very good dyeing and a tight grain in combination with very good body and excellent softness with elegant handle were obtained. The crust leathers 4.2 to 4.3 had a smoother and finer grain than C4. Further performance characteristics are shown in table 4.

| Crust leather | From pelt | Hair removal | Tight-grained character | Stitch tear resistance according to DIN 53331 [N] |
|---|---|---|---|---|
| C4 | C3 | 2 | 2 | 140 |
| 4.1 | 3.1 | 2 | 2 | 176 |
| 4.2 | 3.2 | 1.5 | 1 | 185 |

3.4. Further Treatment of the Residual Liquors

The residual liquors of examples 3.1 and 3.2 according to the invention were acidified to pH 4.5 with formic acid without evolution of hydrogen sulfide being observed. The precipitated proteins were then separated off without problems by filtration. The residual liquors of examples 3.2 to 3.3 were virtually clear.

We claim:

1. A process for removing one or more horny substances from hide, pelt or skin of a dead animal, wherein the hide, pelt or skin is treated in aqueous liquor comprising one or more compounds of the formula I

I

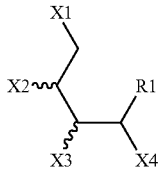

or their corresponding alkali metal or alkaline earth metal salts or ammonium or phosphonium salts:

$R^1$ is selected from the group consisting of hydrogen and $C_1$-$C_{12}$-alkyl, unsubstituted or substituted by one or more S—H or O—H groups;

$X^1$ to $X^4$ are identical or different and are selected from the group consisting of hydrogen, $C_1$-$C_4$-alkyl, O—H, S—H and N—$HR^2$, $R^2$ is hydrogen or $C_1$-$C_{12}$-alkyl or a $C_1$-$C_4$-alkyl-C═O group, at least one radical $X^1$ to $X^4$ being S—H when $R^1$ contains at least one sulfur atom and at least two radicals $X^1$ to $X^4$ being S—H when $R^1$ contains no sulfur atom, wherein one or more basic alkali metal compounds are added and lime is absent, and wherein said process is carried out at a pH value of from 7 to 14.

2. The process as claimed in claim 1, wherein $X^1$ to $X^4$ each O—H or S—H.

3. The process as claimed in claim 1, wherein $R^1$ is hydrogen.

4. The process as claimed in claim 1, wherein said removing produces at least substantial detachment of the epidermis from the hide, pelt or skin.

5. The process as claimed in claim 1, wherein the pH is from 8 to 13.

6. The process as claimed in claim 1, wherein the pH is from 9 to 12.5.

7. The process as claimed in claim 1, wherein the compound of formula I includes at least one compound selected from compounds of the following formulae Ia, Ia' and Ib:

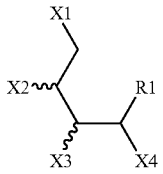

I or their corresponding alkali metal or alkaline earth metal salts or ammonium or phosphonium salts.

8. The process as claimed in claim 7, wherein said at least one compound is a racemic mixture of compounds of formula Ia and Ia'.

9. The process as claimed in claim 1, which additionally comprises forming leather from said hide, pelt or skin.

* * * * *